US009186912B2

(12) United States Patent
Ishizuka

(10) Patent No.: US 9,186,912 B2
(45) Date of Patent: Nov. 17, 2015

(54) LIQUID EJECTION DEVICE

(71) Applicant: SEIKO EPSON CORPORATION, Tokyo (JP)

(72) Inventor: Hirotaka Ishizuka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/970,912

(22) Filed: Aug. 20, 2013

(65) Prior Publication Data

US 2014/0055542 A1 Feb. 27, 2014

(30) Foreign Application Priority Data

Aug. 21, 2012 (JP) ..... 2012-182087

(51) Int. Cl.
*B41J 2/01* (2006.01)
*B41J 11/00* (2006.01)

(52) U.S. Cl.
CPC ..... *B41J 11/0015* (2013.01); *B41J 11/002* (2013.01)

(58) Field of Classification Search
CPC ..... B41J 11/002; B41J 11/0015
USPC ..... 347/102, 101, 17
See application file for complete search history.

(56) References Cited

U.S. PATENT DOCUMENTS 5,005,025 A * 4/1991 Miyakawa et al. ..... 346/25
2003/0122915 A1* 7/2003 Katoh et al. ..... 347/105
2003/0156176 A1* 8/2003 Miyamoto et al. ..... 347/102
2010/0039473 A1* 2/2010 Terada ..... 347/19
2012/0187233 A1* 7/2012 Tenpaku et al. ..... 242/590

FOREIGN PATENT DOCUMENTS

| | | | |
|---|---|---|---|
| EP | 0294793 | A2 | 12/1988 |
| EP | 1474565 | B1 | 3/2008 |
| EP | 2011659 | A1 | 1/2009 |
| EP | 1674275 | B1 | 9/2009 |
| JP | 01-288451 | A | 11/1989 |
| JP | 08-108588 | A | 4/1996 |
| JP | 2006-265813 | A | 10/2006 |
| JP | 2008-214805 | A | 9/2008 |

OTHER PUBLICATIONS

The extended European Search Report for European Application No. 13181043.4 mailed Dec. 5, 2013.

* cited by examiner

*Primary Examiner* — Henok Legesse
(74) *Attorney, Agent, or Firm* — Global IP Counselors, LLP

(57) ABSTRACT

A recording medium includes a supply part that supplies a recording medium; a recording medium conveyance part that has a support surface to support the recording medium and conveys the recording medium; an ejection head that ejects liquid toward the recording medium supported by the recording medium conveyance part; a recording medium collecting part that collects the recording medium; and a heater block as a drying part that is placed between the recording medium conveyance part and the recording medium collecting part and dries the ink applied to the recording medium. A part that is on the most recording medium conveyance part side of the contact surface of the heater block is positioned higher than a part that is on the most heater block side of the support surface in a vertical direction.

10 Claims, 4 Drawing Sheets

LIQUID EJECTION DEVICE

CROSS-REFERENCE TO RELATED APPLICATIONS

This application claims priority to Japanese Patent Application No. 2012-182087 filed on Aug. 21, 2012. The entire disclosure of Japanese Patent Application No. 2012-182087 is hereby incorporated herein by reference.

BACKGROUND

1. Technical Field

The present invention relates to a liquid ejection device.

2. Related Art

A screen printing device, in which a dyeing stencil was used to perform, has been used for printing to a fabric such as cotton, silk, wool, chemical fiber, blended fabric, and the like. However, in recent years, an inkjet printer technology has been improved so that an inkjet printing device, which performs printing by an inkjet printing method, is receiving attention.

The inkjet printing is not required to use a dyeing stencil, which was used in the screen printing, so that a design that is digitalized can be used. Accordingly, small changes for a design requested by a client can be promptly responded and the production time can be dramatically shortened. Also, there is an advantage that the degree of freedom in design such that color gradations can be expressed is large.

For example, Japanese Laid-open Patent Application Publication No. 8-108588 introduces a configuration that in the inkjet printing device, when a fabric as a recording medium is conveyed to an ejection head that performs printing by the inkjet, to improve conveyance accuracy, the fabric is applied to a conveyance belt having adhesion on a support surface that supports the fabric and a recording medium conveyance part is provided to convey the fabric by the conveyance belt driven by a conveyance roller, and the like.

Further, a recording medium supply part that feeds and supplies a fabric to a recording medium conveyance part, an ejection head that ejects liquid to the fabric supported by the recording medium conveyance part, a recording medium collecting part that collects the fabric conveyed from the recording medium conveyance part, and a drying part that is placed between the recording medium conveyance part and the recording medium collecting part and dries the liquid applied to the recording medium are provided with the inkjet printing device described in Japanese Laid-open Patent Application Publication No. 8-108588.

In the inkjet printing device described in the above-mentioned publication, examples of the drying part (drying heater) show to blow hot air to a fabric and to irradiate ultraviolet rays to a fabric.

Other than these drying parts that dry the fabric without contact, it may consider a drying part which is a type that the fabric is contacted to a heater block and is dried by heating.

SUMMARY

However, in the configuration of the inkjet printing device described in Japanese Laid-open Patent Application Publication No. 8-108588, the drying part was a drying heater which was a type without contact so that to dry liquid applied to the printed fabric, for example, it was required to set a heater unit having high specifications of ten kilowatt or several tens of kilowatts level, and the power consumption increased in the drying process so that the device cost or the production cost possibly became increased.

Further, to stabilize a position of a fabric to the drying part which was a type without contact, guide rollers were placed near an entrance and an exit of the drying part, and specifically, the guide roller placed near the entrance contacted to the fabric before drying so that the liquid printed to the fabric was soaked and reached to a contact surface of the guide roller. The liquid was adhered to the contact surface of the guide roller so that it possibly caused a drawing failure because a fabric to be conveyed later, which has already been printed, was soiled.

The present invention is to solve at least a part of the above problems and the following embodiments and applicable examples are possible to be realized.

According to an aspect of the invention, a liquid ejection device includes a recording medium supply part, a recording medium conveyance part, an ejection head, a recording medium collecting part and a drying part. The recording medium supply part is configured and arranged to supply a recording medium. The recording medium conveyance part has a support surface to support the recording medium, and configured and arranged to convey the recording medium. The ejection head is configured and arranged to eject liquid toward the recording medium. The recording medium collecting part is configured and arranged to collect the recording medium. The drying part is placed between the recording medium conveyance part and the recording medium collecting part, and configured and arranged to dry the liquid applied to the recording medium. The drying part is a heater block having a contact surface to which the recording medium contacts, and a part of the contact surface that is disposed closest to the recording medium conveyance part being positioned higher in a vertical direction than a part of the support surface that is disposed closest to the drying part.

According to another aspect of the invention, the recording medium is held in the part of the contact surface of the drying part that is disposed closest to the recording medium conveyance part side so that the recording medium is held with a certain tension between the recording medium conveyance part and the drying part. Thus, the conveyance of the recording medium can be stabilized without using a guide roller. Also, the recording medium is dried by contacting to the contact surface of the drying part so that liquid applied to the recording medium can be efficiently dried with a low energy. Because of this, without making a complicated configuration of the drying part or the conveyance system, it is possible to convey the recording medium with excellent stability, to efficiently dry liquid applied to the recording medium, and to suppress a drawing failure caused by soiling on the guide roller.

Therefore, while suppressing the raise of the device cost or the production cost, it is possible to provide the liquid ejection device that conveys a recording medium with stability and enables to produce high quality printing.

In the liquid ejection device of the aspect described above, it is preferable that the drying part is placed higher than the recording medium collecting part in the vertical direction, and the contact surface has a slope going down toward the recording medium collecting part.

According to another aspect of the invention, the contact surface of the drying part has a slope going down toward the recording medium collecting part placed lower in the vertical direction so that the bend of the recording medium conveyed to the recording medium collecting part from the drying part becomes small so that the recording medium is conveyed with stability, and the contact area of the recording medium to the contact surface is secured with large so that the drying efficiency can be improved.

In the liquid ejection device of the aspect described above, in a cross-sectional shape of the drying part, it is characterized that the contact surface has a shape including a bend part that projects toward a contact surface side.

According to another aspect of the invention, it is possible to obtain greater effect for the contact stabilization of the recording medium to the contact surface and the large contact area of the contact surface with the recording medium.

In the liquid ejection device of the aspect described, in the cross-sectional shape of the drying part, it is preferable that the contact surface has a shape including a circular arc that expands to a contact surface side.

According to another aspect of the invention, it is possible to remarkably obtain greater effect for the contact stabilization of the recording medium to the contact surface and the large contact area of the contact surface with the recording medium. As well as, the friction to the recording medium during the conveyance of the recording medium is suppressed so that the conveyance can be effectively stabilized.

In the liquid ejection device of the aspect described above, it is preferable that a shaft of the recording medium collecting part is placed on a recording medium conveyance side than an edge part which is an opposite side of the recording medium conveyance side of the drying part in a plan view.

According to another aspect of the invention, the recording medium is held with a certain tension between the drying part and the recording medium collecting part in a part that is the most recording medium collecting part side of the contact surface of the drying part so that the conveyance of the recording medium is stabilized. Also, the recording medium is contacted to the contact surface with stability, and the stable large contact area between the recording medium and the contact surface can be secured so that liquid applied to the recording medium can be efficiently and remarkably dried.

In the liquid ejection device of the aspect described, a position detection part is placed lower than a part, which is the most drying part side of the support surface between the recording medium conveyance part and the drying part, in the vertical direction, and detects the recording medium, which is fed from the recording medium conveyance part and hangs down between the recording medium conveyance part and the drying part; and a controller controls collecting a predetermined amount of the recording medium by driving the recording medium collecting part when the position detection part detects the recording medium.

According to another aspect of the invention, with a simple device configuration, it can provide the liquid ejection device that conveys the recording medium without applying unnecessary tension to the recording medium, and in addition, while maintaining appropriate tension so as to enable to draw.

In the liquid ejection device of the aspect described, an interleaf supply part supplies an interleaf in the recording medium conveyance part side of the drying part so as to convey a sheet-shaped interleaf, which is sandwiched between the contact surface of the drying part and the recording medium, with the recording medium.

According to another aspect of the invention, even when liquid ejected to the recording medium in the recording medium conveyance part is soaked to the recording medium and reaches to the contact surface, the interleaf between the recording medium and the contact surface is existed so that the contact surface is not soiled. Because of this, it can be prevented from the drawing failure such that the liquid adhered onto the contact surface of the drying part soils the recording medium to be conveyed later.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, the embodiments of the present invention will be described in reference to the drawings.

First Embodiment

The first embodiment of the liquid ejection device of the present invention will be described.

Figure 1:
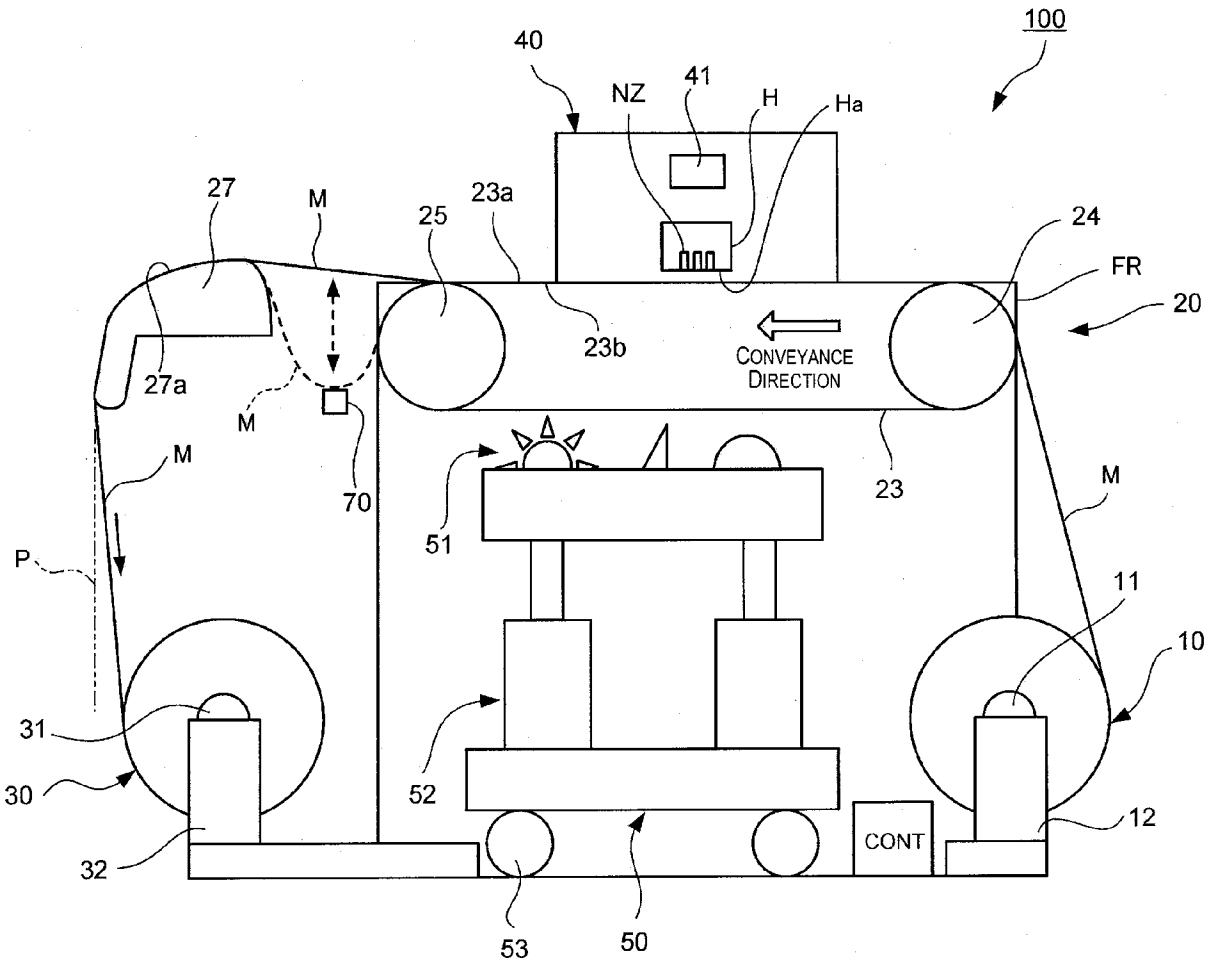
FIG. 1 is a diagram illustrating schematic configuration of a printing device according to the first embodiment.

FIG. 1 is a diagram illustrating schematic configuration of a printing device according to the first embodiment of the invention. Also, FIG. 2 is a perspective view illustrating a configuration of a part of the printing device according to the first embodiment.

Figure 2:
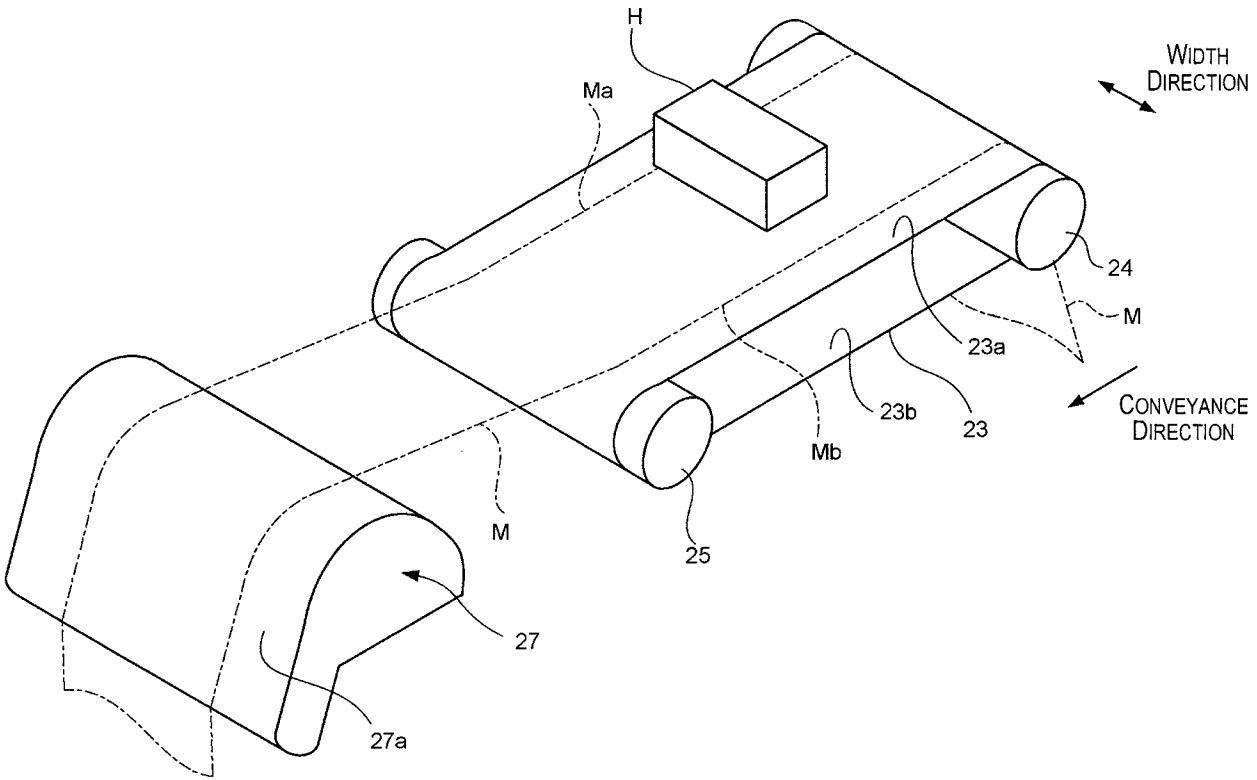
FIG. 2 is a perspective view illustrating a configuration of a part of the printing device according to the first embodiment.

As shown in FIG. 1 and FIG. 2, the printing device (liquid ejection device) 100 has a recording medium supply part 10, a recording medium conveyance part 20, a recording medium collecting part 30, an inkjet part 40, a heater block 27 as a drying part, a maintenance part 50, a position detection part 70, and a controller CONT. The respective parts of the printing device 100 are attached to the frame part FR.

The printing device 100 forms an image on a recording medium M so as to perform a printing of the recording medium M. As the recording medium M, for example, a fabric such as cotton, silk, wool, chemical fiber, blended fabric, and the like is used. In the present embodiment, a configuration forming an image in a roll method to the band-shaped (sheet-shaped) recording medium M will be described.

The recording medium supply part 10 supplies the recording medium M that is not performed an image forming. The recording medium supply part 10 has a shaft 11 and a bearing 12.

The shaft 11 forming a cylindrical shape or a columnar shape is provided rotatably in a circumferential direction. In the shaft 11, the band-shaped recording medium M is rolled as a roll shape. The shaft 11 is detachably attached to the bearing 12. Therefore, for example, the shaft 11 in which the recording medium M has preliminary been rolled can be fixed to the bearing 12.

The bearing 12 rotatably supports both ends of the shaft 11 in a direction of axis. The bearing 12 has a rotation driving part, which is not shown in the drawing, to rotationally drive the shaft 11. The rotation driving part rotates the shaft 11 in a direction that the recording medium M is fed out. The operation of the rotation driving part is controlled by, for example, the controller CONT.

The recording medium conveyance part 20 conveys the recording medium M from the recording medium supply part 10 to the recording medium collecting part 30. The recording medium conveyance part 20 has a conveyance belt 23, a belt rotation roller 24, and a belt rotation roller 25.

By the way, it does not shown in the drawing, but to stabilize the conveyance of the recording medium M, a guide roller (conveyance roller) may be placed in an appropriate position of a conveying route of the recording medium M.

The conveyance belt 23 forms an endless shape, and is wound on a belt rotation roller 24 and a belt rotation roller 25. To become a part of the conveyance belt 23 between the belt rotation roller 24 and the belt rotation roller 25 parallel to a floor surface, the conveyance belt 23 is held in the state that a predetermined tensile force acts. In the front surface of the conveyance belt 23 (support surface 23*a*), an adhesive layer (not shown in the drawing) to adhere the recording medium M is provided. The conveyance belt 23 supports the recording medium M on the support surface 23*a* on which the adhesive layer is provided. The support surface 23*a* is defined by the first direction (conveyance direction) and the second direction (width direction) that intersect each other.

The belt rotation roller 24 and the belt rotation roller 25 support an inner circumference surface 23*b* of the conveyance belt 23. By the way, it may be a configuration that a support part supporting the conveyance belt 23 is provided between the belt rotation roller 24 and the belt rotation roller 25. The belt rotation roller 24 is rotated in accordance with the rotation of the conveyance belt 23. The belt rotation roller 25 is rotated by the rotation driving part (motor, or the like) that is not shown in the drawing. The rotation driving part is controlled by the controller CONT.

The conveyance belt 23 is rotated by the rotation of the belt rotation roller 25, and the belt rotation roller 24 is rotated by the rotation of the conveyance belt 23. The recording medium M supported by the conveyance belt 23 is conveyed by the rotation of the conveyance belt 23 in a predetermined conveyance direction. In the present embodiment, a direction from the belt rotation roller 24 to the belt rotation roller 25 is the conveyance direction. Thus, for example, when the belt rotation roller 24 and the belt rotation roller 25 are compared, the belt rotation roller 24 is placed upstream side of the conveyance direction and the belt rotation roller 25 is placed downstream side of the conveyance direction.

The heater block 27 is heated to a predetermined temperature by a heater chip, which is not shown in the drawing, disposed in a part of the heater block 27. The recording medium M conveyed from the recording medium conveyance part 20 is contacted to the contact surface 27*a*, and the ink as liquid ejected to the recording medium M is dried. In this configuration, the recording medium M is dried by contacting to the contact surface 27*a* of the heater block 27 so that the ink applied to the recording medium M can be efficiently dried in the low energy.

The recording medium collecting part 30 collects the recording medium M, which is conveyed by the recording medium conveyance part 20 and is dried by the heater block 27. The recording medium collecting part 30 has a shaft 31 and a bearing 32.

The shaft 31 forming a cylindrical shape or a columnar shape is provided rotatably in a circumferential direction. In the shaft 31, the band-shaped recording medium M is rolled as a roll shape. The shaft 31 is detachably fixed to the bearing 32. Therefore, for example, in the state that the recording medium M is wounded on the shaft 31, by detaching the shaft 31 from the bearing 32, the recording medium M is detachable with the shaft 31.

The bearing 32 rotatably supports both ends of the shaft 31 in a direction of axis. The bearing 32 has a rotation driving part, which is not shown in the drawing, to rotationally drive the shaft 31. The rotation driving part rotates the shaft 31 in a direction that the recording medium M is wounded. The operation of the rotation driving part is controlled by, for example, the controller CONT.

Here, a shape or a placement of the heater block as a drying part (heating part) that is a main section of the printing device (liquid ejection device) 100 of the invention will be described in detail. The heater block 27 is formed by processing a metal such as, for example, aluminum, or the like, and has a contact surface 27*a* that contacts to a surface opposite of the ink applied surface of the recording medium M where the ink was applied in the recording medium conveyance part 20. The heater block 27 is placed higher than the recording medium collecting part 30 in the vertical direction (direction intersecting the first direction and the second direction), and the contact surface 27*a* has a slope going down to the recording medium collecting part 30 side. In the present embodiment, in the cross-sectional shape of the heater block 27, the contact surface 27*a* forms a slope having a circular arc that expands to the contact surface 27*a* side. Because of this, the contact surface of the recording medium M to the contact surface 27*a* of the heater block 27 is largely secured so that the drying efficiency can be improved. Also, as well as in the case that the contact surface is the surface parallel to the support surface 23*a* of the recording medium conveyance part 20, the recording medium M is not largely bent to the recording medium collecting part 30 that is lower in the vertical direction from the parallel contact surface so that the conveyance of the recording medium M becomes smooth and can be stabilized.

Further, in the cross-sectional shape of the heater block 27 as the drying part of the present embodiment, the contact surface 27*a* has a shape including a circular arc that expands to the contact surface 27*a* side. Because of this, specifically, a contact stability of the recording medium M to the contact surface 27*a*, and an effect to become larger contact area between the recording medium M and the contact surface 27*a* can be remarkably obtained, and as well as, the friction to the recording medium M during the conveyance of the recording medium M is suppressed so that the conveyance of the recording medium M is stabilized.

In addition, a part that is the recording medium conveyance part 20 side of the contact surface 27*a* in the heater block 27 is placed in a position higher than a part that is the most heater block 27 side of the support surface 23*a* of the recording medium conveyance part 20 (i.e., a part of the support surface 23*a* that is disposed closest to the heater block 27) in the vertical direction. Because of this, the recording medium M between the recording medium conveyance part 20 and the heater block 27 is held with an appropriate tension in a part that is the most recording medium conveyance part 20 side of the contact surface 27*a* of the heater block 27 (i.e., a part of the contact surface 27*a* that is disposed closest to the recording medium conveyance part 20) so that the conveyance of the recording medium M can be stabilized without using other conveyance members such as a guide roller. Therefore, the configuration of the drying part (heater block 27 in the present embodiment) or the conveyance system does not have to be complicated, and it becomes possible to convey the recording medium M with excellent stability. Also, it is prevented from a drawing failure caused by soiling the conveyance member with ink when another conveyance member such as a guide roller is placed between the recording medium conveyance part 20 and the heater block 27.

Moreover, the heater block 27 is placed in a position where the shaft 31 of the recording medium collecting part 30 is positioned in the recording medium conveyance part 20 side than the end part that is the opposite side from the recording medium conveyance part 20 side of the heater block 27 in the plan view. Because of this, the recording medium M between the heater block 27 and the recording medium collecting part 30 is held with a certain tension in a part that is the most recording medium collecting part 30 side of the contact surface 27*a* of the heater block 27 so that the recording medium M is conveyed with stability. Also, the recording medium M is securely contacted to the contact surface 27*a* and a large contact area between the recording medium M and the contact surface 27*a* can be steadily secured so that the ink applied to the recording medium M can be dried efficiently.

The specific description of the heater block 27 as the drying part is discussed above, and next, the configuration of the printing device 100 of the present embodiment will be described.

An inkjet part 40 ejects ink to the recording medium M. The inkjet part 40 has an ejection head H and a head movement part 41. The ejection head H is set with an ejection surface Ha that ejects the ink. In the ejection surface Ha, a plurality of nozzles NZ is formed to discharge the ink. The ejection surface Ha is placed toward the recording medium M that is conveyed by the conveyance belt 23. The head movement part 41 moves the ejection head H to a direction (e.g., width direction of the recording medium M) that intersects with the conveyance direction.

A maintenance part 50 performs maintenance of the conveyance belt 23. The maintenance part 50 has a processing part 51, a base 52, and a move part 53. For example, the processing part 51 has devices that perform various processes to the conveyance belt 23 such as a maintenance device that cleans ink, dust, line, or the like adhered to the conveyance belt 23, an adhesive layer repair device that repairs the adhesive layer when the adhesive layer of the conveyance belt 23 is deteriorated, and the like. The base 52 supports the processing part 51. The base 52 may have a lifting part that moves up and down the processing part 51. The move part 53 integrally moves the processing part 51 and the base 52 along a floor surface.

A position detection part 70 is placed between the recording medium conveyance part 20 and the heater block 27, and is placed in a height lower than a position that is the most heater block 27 side of the support surface 23*a* of the conveyance belt 23 in the vertical direction. The position detection part 70 detects the recording medium M that hangs down between the recording medium conveyance part 20 and the heater block 27 (indicating in a broken line in the drawing) and fed from the recording medium conveyance part 20. As the position detection part 70, for example, an optical sensor, a CCD sensor, and the like can be used.

The controller CONT controls to drive the recording medium collecting part 30 so as to collect a predetermined amount of the recording medium M when the recording medium M is detected by the position detection sensor 70. Here, the predetermined amount indicates the straight recording medium M to be held in the state that the recording medium M between the recording medium conveyance part 20 and the heater block 27 is held in a certain tension.

Therefore, in the method for the conveyance control of the recording medium M in the recording medium collecting part 30 driven by the controller CONT based on the position detection of the recording medium M in the position detection part 70, the device configuration becomes simple and unnecessary tension does not apply to the recording medium M. In addition, it is possible to draw an image while conveying the recording medium M held with an appropriate tension.

Next, operations of the printing device 100 with the above described configuration will be described.

When an image data is input from an exterior to the printing device 100, an image, which corresponds to the input image data, is formed on the recording medium M by the controller CONT. First, the flow of the operations to form an image to the recording medium M will be described.

The controller CONT controls to rotate the shaft 11 to feed the recording medium M from the recording medium supply part 10. The recording medium M fed from the recording medium supply part 10 is supported by the conveyance belt 23. In this time, a pushing part to push the recording medium M down to the support surface 23*a* of the conveyance belt 23 (not shown in the drawing) is used so that it supports in the state that the recording medium M is applied to the support surface 23*a* without any lifting space.

The conveyance belt 23 has adhesiveness on the support surface 23*a* so that the recording medium M is conveyed in the state that the recording medium M is applied to the support surface 23*a*. The controller CONT controls to rotate the belt rotation roller 25 and to move the conveyance belt 23 in the conveyance direction. In this operation, the recording medium M is conveyed in the conveyance direction by the conveyance belt 23.

After the recording medium M reached to a predetermined position on the conveyance belt 23, the controller CONT controls to discharge ink from the nozzles NZ while the ejection head H is moved in the width direction of the recording medium M. The controller CONT controls to move the recording medium M in the conveyance direction by a predetermined distance every time the ejection head H scans the recording medium M in the width direction. The controller CONT controls to rotate the belt rotation roller 25 by a predetermined angle at a time of the movement. Because of this, the controller CONT controls to intermittently move the recording medium M in the conveyance direction, and the ejection head H scans to eject ink from the nozzles NZ so that a predetermined image is formed to the recording medium M.

The controller CONT controls to move the recording medium M, in which the image was formed, to the downstream side of the conveyance belt 23. The recording medium M moved to the downstream side of the conveyance belt 23 reaches to the recording medium collecting part 30 through the heater block 27. When the controller CONT controls to move the recording medium M to the downstream side of the conveyance belt 23, the recording medium M is going to be hanged down on the lower side in the vertical direction between the conveyance belt 23 and the heater block 27. When the hanged down recording medium M was detected by the position detection part 70, the controller CONT controls to drive the recording medium collecting part 30 so as to collect the recording medium M until the recording medium M between the recording medium conveyance part 20 and the heater block 27 becomes straight and is held in a certain tension (the recording medium M indicating in a solid line in the drawing).

As described above, in the present embodiment, the heater block 27 functions as a conveyance guide to hold the recording medium M between the upstream side of the recording medium conveyance part 20 and the downstream side of the recording medium collecting part 30, and as well as, a drying part to directly heat the recording medium M, in which ink was ejected, in close contact. In addition, in the cross-sectional shape of the heater block 27, the contact surface 27*a* of the heater block 27 forms a slope having a circular arc that expands to the contact surface side 27*a*. Because of this, the printing device 100, in which the device configuration is not complicated, the recording medium M is conveyed with stability, and the efficiency of drying ink is possible to be realized, can be provided.

Also, a conveyance member such as a guide roller is diminished so as to reduce the device cost, and it can be prevented from a drawing failure that may be caused by soiling the conveyance member with ink when it is placed in the upstream side of the heater block 27 as a drying part.

Second Embodiment

Next, another embodiment of the printing device as a liquid ejection device will be described.

Figure 3:
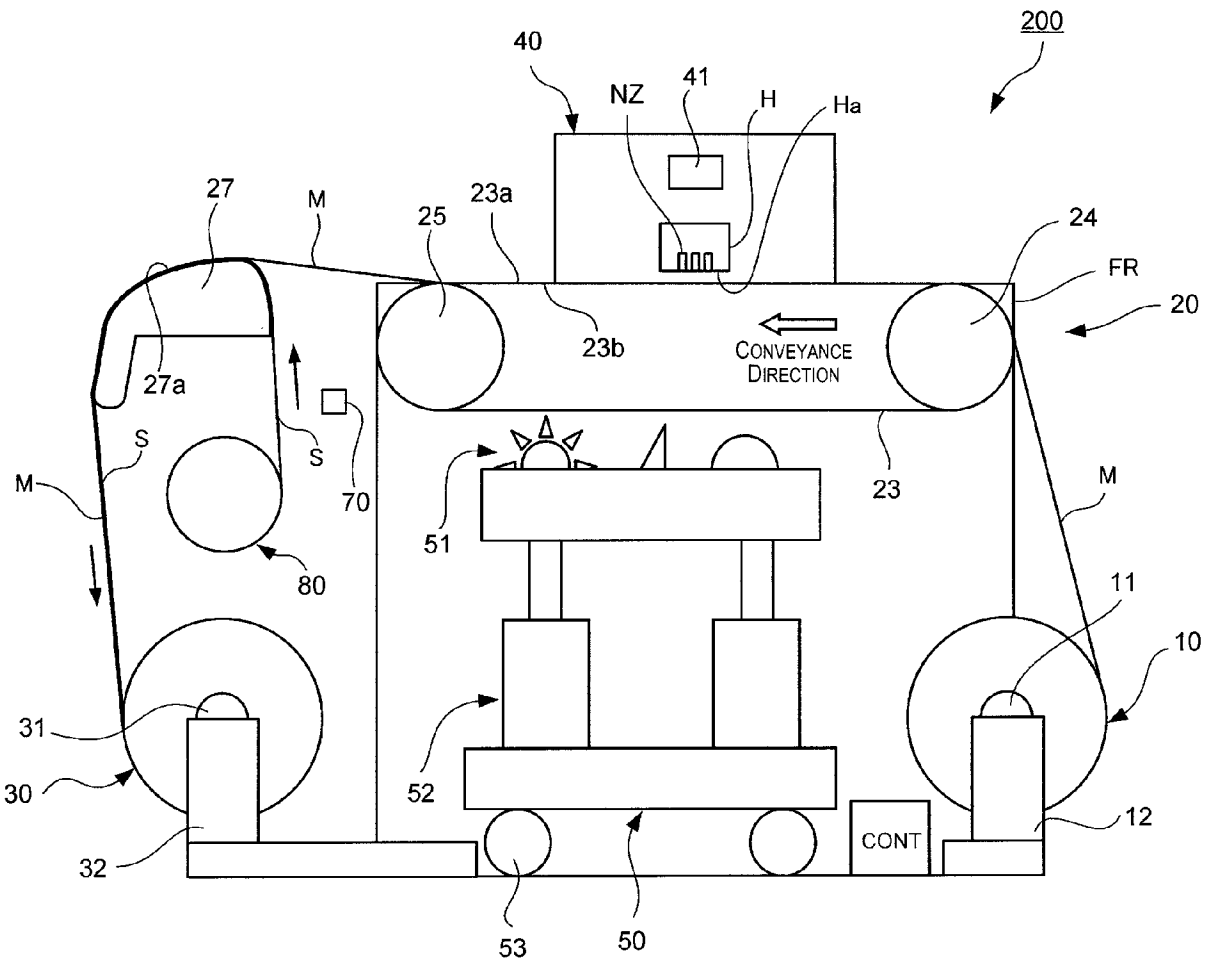
FIG. 3 is a diagram illustrating schematic configuration of a printing device according to the second embodiment.

FIG. 3 is a diagram illustrating schematic configuration of a printing device according to the second embodiment of the present invention. By the way, in the present embodiment, the description of the same configuration as the first embodiment described above will be omitted so as to refer the same symbols in the drawing.

In FIG. 3, the printing device 200 of the second embodiment has a recording medium supply part 10, a recording medium conveyance part 20, a recording medium collecting part 30, an inkjet part 40, a heater block 27, a maintenance part 50, a position detection part 70, and a controller CONT in the same manner as the printing device of the first embodiment (see FIG. 1 and FIG. 2). The respective parts are attached with the frame part FR.

In the conveyance route of the recording medium M, an interleaf supply part 80 that supplies a sheet-shaped interleaf S between the heater block 27 and the recording medium M is provided in the upstream side of the heater block 27 as a drying part.

The interleaf S, which is fed from the interleaf supply part 80 and is overlapped with a surface of the recording medium M on the side contacted to the contact surface 27*a* in the recording medium conveyance part 20 side of the heater block 27, is conveyed to the recording medium collecting part 30 side with the recording medium M in the state that it is sandwiched between the contact surface 27*a* and the recording medium M. The present embodiment shows a configuration that the interleaf S, which was overlapped with the recording medium M and conveyed with the recording medium M on the heater block 27, is rolled up in the recording medium collecting part 30 with the recording medium M. However, it may be a configuration that an interleaf collecting part may be provided on the side to rewind the interleaf S only in the recording medium collecting part 30 side of the heater block 27, and the recording medium collecting part 30 only collects the recording medium M.

In the configuration of the second embodiment, when the ink as liquid ejected to the recording medium M from the ejection head H of the inkjet part 40 in the recording medium conveyance part 20 is soaked to the recording medium M and reaches to the contact surface 27*a*, the interleaf S is existed between the recording medium M and the contact surface 27*a* so that the contact surface 27*a* of the heater block 27 is not soiled. Because of this, it can be prevented from a drawing failure that the ink adhered to the contact surface 27*a* of the heater block 27 soils the recording medium M to be conveyed later.

The technological scope of the invention is not limited to the above described embodiments, and an appropriate modification may be made in a scope not deviating from the significance of the invention.

In the embodiments described above, for example, in the cross-sectional shape of the heater block 27 as a drying part, the contact surface 27*a* has a shape including a circular arc that expands to the contact surface 27*a* side. This was described as an example so that it is not limited to this.

Figure 4:
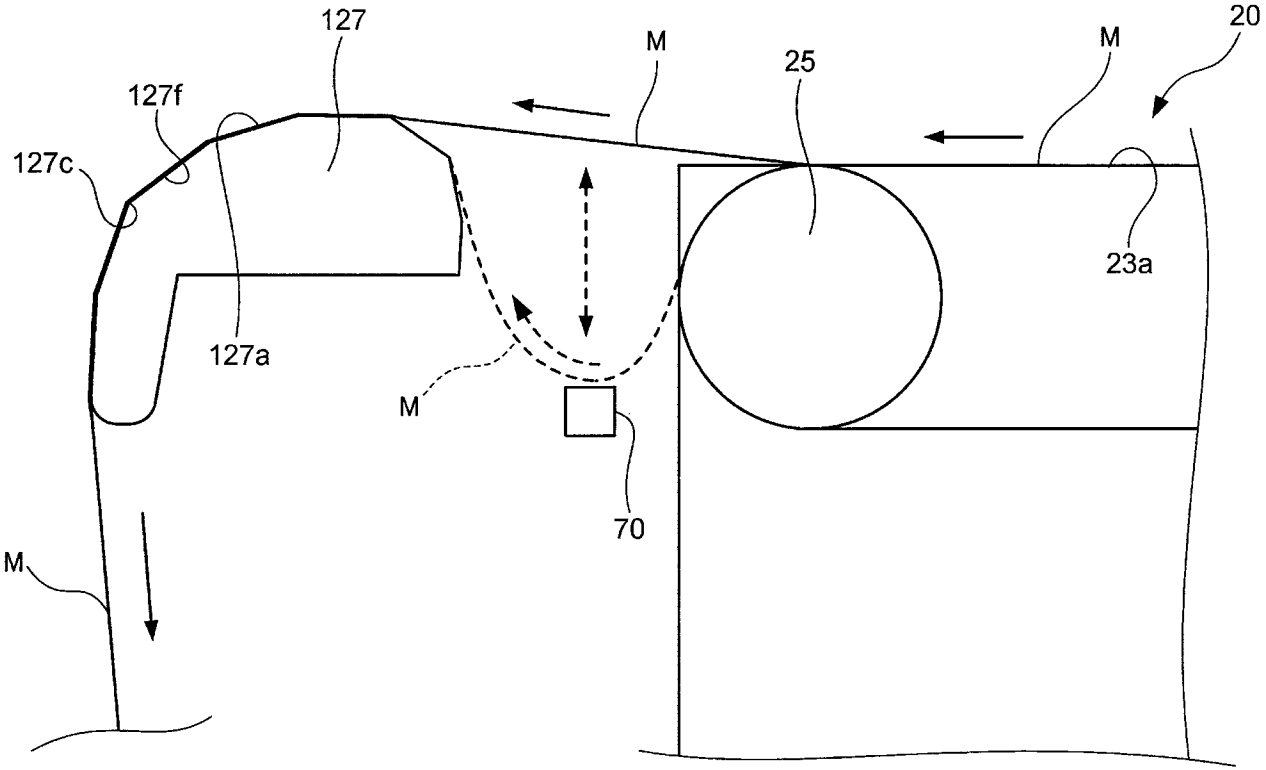
FIG. 4 is a diagram illustrating a configuration of a part of a modification of the printing device.

For example, in the cross-sectional shape of the heater block 127 as shown in FIG. 4, it may have a configuration that the contact surface 127*a* has a shape including a bend part 127*c* that projects to the contact surface 127*a* side, and a flat part 127*f* that forms a slope in both sides of the bend part 127*c*.

By the way, in FIG. 4, an example of the configuration was shown that in the cross-sectional shape, the heater block 127 has a plurality of bend parts 127*c* in the contact surface 127*a*. However, it may be a configuration that includes more bend parts than the bend parts 127*c* of the heater block 127 shown in FIG. 4.

Also, in the embodiments as described above, it described an example of the configuration that the support surface 23*a* of the conveyance belt 23 has the adhesive layer, and the recording medium M is held by the adhesion of the adhesive layer. However, it is not limited to this. For example, it may be a configuration that the recording medium M is held by electrostatic adsorption or vacuum contact.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a recording medium supply part configured and arranged to supply a recording medium;

a recording medium conveyance part having a support surface with adhesiveness to support the recording medium, and configured and arranged to convey the recording medium;

an ejection head configured and arranged to eject liquid toward the recording medium;

a recording medium collecting part configured and arranged to collect the recording medium that has been supplied from the recording medium supply part along a conveyance path of the recording medium; and a drying part disposed downstream of the conveyance path of the recording medium with respect to the ejection head between the recording medium conveyance part and the recording medium collecting part along the conveyance path of the recording medium, and configured and arranged to dry the liquid applied to the recording medium, the drying part being a heater block having a contact surface to which the recording medium contacts, and at least a part of the contact surface being positioned higher in a vertical direction than a part of the support surface that is disposed closest to the drying part, the contact surface further having a first slope gradually downwardly extending toward the recording medium conveyance part with respect to an uppermost location of the contact surface in the vertical direction and a second slope gradually downwardly extending away from the recording medium conveyance part with respect to the uppermost location of the contact surface in the vertical direction.

2. The liquid ejection device according to claim 1, wherein the drying part is placed higher than the recording medium collecting part in the vertical direction, and the second slope goes down toward the recording medium collecting part.

3. The liquid ejection device according to claim 2, wherein in a cross-sectional shape of the drying part, the contact surface has a shape including a bend part projecting toward a contact surface side.

4. The liquid ejection device according to claim 2, wherein a shaft of the recording medium collecting part is placed on a recording medium conveyance side than an edge part which is an opposite side of the recording medium conveyance side of the drying part in a plan view.

5. The liquid ejection device according to claim 1, wherein in the cross-sectional shape of the drying part, the contact surface has a shape including a circular arc expanding toward a contact surface side.

6. The liquid ejection device according to claim 1, further comprising a position detection part placed lower in the vertical direction than a part of the support surface, which is disposed between the recording medium conveyance part and the drying part and disposed closest to the drying part, and configured and arranged to detect the recording medium, which is fed from the recording medium conveyance part and hangs down between the recording medium conveyance part and the drying part, and a controller configured to control collecting of a predetermined amount of the recording medium by driving the recording medium collecting part when the position detection part detects the recording medium.

7. The liquid ejection device according to claim 1, further comprising an interleaf supply part configured and arranged to supply an interleaf in a recording medium conveyance part side of the drying part so as to convey a sheet-shaped interleaf, which is sandwiched between the contact surface of the drying part and the recording medium, with the recording medium.

8. The liquid ejection device according to claim 1, wherein the support surface of the recording medium conveyance part is configured to support the recording medium while contacting with a first surface of the recording medium, and the contact surface of the drying part is further configured to support the recording medium while contacting with the first surface of the recording medium.

9. The liquid ejection device according to claim 8, wherein the ejection head is further configured and arranged to eject the liquid on a second surface of the recording medium, with the first and second surfaces oppositely facing with respect to each other.

10. The liquid ejection device according to claim 1, wherein the recording medium collecting part is disposed lower than the drying part in the vertical direction at a location spaced apart from the drying part in the vertical direction such that the conveyance path of the recording medium from an edge of the second slope of the drying part to the recording medium collecting part extends in a direction inclined toward the recording medium conveyance part with respect to the vertical direction as approaching the recording medium collecting part.

* * * * *